US007824204B2

(12) United States Patent
Fujiwara et al.

(10) Patent No.: US 7,824,204 B2
(45) Date of Patent: Nov. 2, 2010

(54) CONNECTOR FOR SERVING BOTH SCREW TYPE AND BAYONET TYPE CONNECTORS

(75) Inventors: Taijiro Fujiwara, Kyoto (JP); Ryoichi Takeuchi, Kyoto (JP); Hisakazu Yamada, Kyoto (JP); Atsushi Yokoigawa, Kyoto (JP)

(73) Assignee: OMRON Corporation, Kyoto-shi, Kyoto (JP)

( * ) Notice: Subject to any disclaimer, the term of this patent is extended or adjusted under 35 U.S.C. 154(b) by 20 days.

(21) Appl. No.: 12/088,657

(22) PCT Filed: Sep. 7, 2006

(86) PCT No.: PCT/JP2006/317718

§ 371 (c)(1),
(2), (4) Date: Jun. 10, 2008

(87) PCT Pub. No.: WO2007/040013

PCT Pub. Date: Apr. 12, 2007

(65) Prior Publication Data

US 2009/0269958 A1 Oct. 29, 2009

(30) Foreign Application Priority Data

Sep. 30, 2005 (JP) ..... 2005-287992

(51) Int. Cl.
*H01R 4/38* (2006.01)
*H01R 13/62* (2006.01)

(52) U.S. Cl. ..... 439/320; 439/311

(58) Field of Classification Search ..... 439/320, 439/319, 311, 314, 359, 339, 316, 313

See application file for complete search history.

(56) References Cited

U.S. PATENT DOCUMENTS 4,440,464 A * 4/1984 Spinner ..... 439/218

(Continued)

FOREIGN PATENT DOCUMENTS

DE 30 22 102 11/1981

(Continued)

OTHER PUBLICATIONS

International Search Report (English & Japanese) for PCT/JP2006/317718 mailed Dec. 12, 2006 (2 pages).

(Continued)

*Primary Examiner*—Hae Moon Hyeon
(74) *Attorney, Agent, or Firm*—Osha · Liang LLP

(57) ABSTRACT

A connector includes a plug and a socket that are connected and integrated to each other. The plug and socket each have an end to which a connection line may be respectively connected. The plug of the connector includes a plug body for connecting to the connection line and having a fitting recess on one end, a plug holder configured to be freely rotatably fitted over the plug body without slipping, and a stopper fitting configured to be freely rotatably fitted over the plug body and slidable in the shaft center direction. The socket of the connector includes a socket body for connecting to the connection line at one end and a socket holder. The socket body has an insertion portion configured so as to fit into the fitting recess of the plug body. The socket holder is configured to be freely rotatably fitted over the socket body without slipping.

12 Claims, 16 Drawing Sheets

U.S. PATENT DOCUMENTS

| | | | | |
|---|---|---|---|---|
| 6,280,229 | B1 * | 8/2001 | Harting et al. | 439/393 |
| 6,957,972 | B2 * | 10/2005 | Starke et al. | 439/320 |
| 6,994,579 | B2 * | 2/2006 | Yokoigawa et al. | 439/320 |
| 2005/0118853 | A1 * | 6/2005 | Starke et al. | 439/320 |
| 2005/0239311 | A1 * | 10/2005 | Yokoigawa et al. | 439/311 |

FOREIGN PATENT DOCUMENTS

| | | |
|---|---|---|
| FR | 2 484 719 | 12/1981 |
| JP | 3-25876 | 2/1991 |
| JP | 2001-52821 | 2/2001 |
| JP | 2002-237348 | 8/2002 |

OTHER PUBLICATIONS

Patent Abstracts of Japan 03-025876 dated Feb. 4, 1991 (1 page).
Patent Abstracts of Japan 2002-237348 dated Aug. 23, 2002 (1 page).
Patent Abstracts of Japan 2001-052821 dated Feb. 23, 2001 (1 page).
International Preliminary Report on Patentability from PCT/JP2006/317718 dated Apr. 10, 2008 (2 pages).
English Translation of International Preliminary Report on Patentability from PCT/JP2006/317718 dated Apr. 10, 2008 (2 pages).
English Translation of Written Opinion of the International Searching Authority from PCT/JP2006/317718 dated Apr. 10, 2008 (3 pages).
English translation of DE3022102, Publication Date: Nov. 26, 1981, 5 pages.
Chinese office action for patent application No. 2006800444580, Dated Dec. 4, 2009, and English translation thereof, 4 pages.

* cited by examiner

CONNECTOR FOR SERVING BOTH SCREW TYPE AND BAYONET TYPE CONNECTORS

CROSS REFERENCE TO RELATED APPLICATIONS

This application is the US National Phase of PCT application PCT/JP2006/317718, filed Sep. 7, 2006, published Dec. 4, 2007 as WO/2007/040013 which claims the priority of Japanese Patent Publication No. 2005-287992, filed Sep. 30, 2005.

TECHNICAL FIELD

The present invention relates to a connector, in particular to a connector that can serve both as a screw type connector and a bayonet type connector.

BACKGROUND ART

A conventional connector includes a screw type connector in which electrical cables are connected on the same shaft center through a screw (see JP2002-237348A). In the screw type connector, since it is required to rotate a plug or a socket many times in order to connect the cables, connection operation takes labor, and operability is low. Also, a wide operation space is required, and consequently the connector has a low integration density. Further, for securing a predetermined waterproof property or reliability of electrical connection, a predetermined fastening torque is always required. However, in the above screw type connector, the fastening torque may be loosened due to application of microvibration and therefore, torque control is always required. Accordingly, maintenance takes labor.

On the other hand, as a connector that solves the above problems, for example, there is a so-called bayonet type connector (See JP2001-52821A). However, the bayonet type connector cannot be connected to the screw type connector. Therefore, to improve connection operability and maintenance property, it is necessary to exchange the entire plug and socket of the screw type connector for those of the bayonet type connector, which is wasteful.

SUMMARY

A connector according to one or more embodiments of the present invention includes a plug and a socket that are connected and integrated to each other at one end, the plug and the socket each having another end to which a connection line may be respectively connected, whereby the connection lines connected respectively to the plug and socket are connected to each other. The plug includes a plug body for connecting to the connection line on one end thereof and having a fitting recess on the other end thereof, a plug holder shaped in a substantially cylindrical form and configured to be freely rotatably fitted over the plug body without slipping off an outer peripheral surface of the plug body, and a stopper fitting biased outward along the shaft center direction and configured to be freely rotatably fitted over the plug body and separately slidable in the shaft center direction. The plug holder includes a male screw portion formed on one end side of the outer peripheral surface of the plug holder, an annular rib for rotational operation extended from an edge portion on the one end side of the outer peripheral surface, and at least one guide groove formed in the outer peripheral surface in a shaft center direction. The stopper includes a ring portion and at least one engagement pawl protruding from the ring portion toward the guide groove of the plug holder in a direction parallel to the shaft center direction, and configured to be engageable with the plug holder so that the stopper fitting is integrally rotatable with the plug holder, wherein an engagement projection is provided at a tip end of each of the at least one engagement pawl. The socket includes a socket body for connecting to the connection line at one end thereof and having an insertion portion protrusively provided on the other end portion, wherein the insertion portion is configured so as to fit into the fitting recess of the plug body, and a socket holder shaped in a substantially cylindrical form, and configured to be freely rotatably fitted over the socket body without slipping off the socket body such that the socket holder rotates in an opposite direction with respect to the plug holder. The socket holder includes L-shaped engagement grooves formed on an opening edge side of the socket holder, and configured to be engageable with the engagement projections provided at the tip end of the at least one engagement pawl of the stopper fitting, and a female screw portion formed on an inner peripheral surface of the socket holder and configured to be engageable with the male screw portion of the plug holder.

According to one or more embodiments of the present invention, since the engagement projections of the engagement pawls of the stopper fitting that construct the plug are engaged with the L-shaped engagement grooves of the socket holder that construct the socket, an angle of rotation of the plug or socket for locking is smaller than that of a conventional example. Therefore, a connector which has high connection operability, does not require a wide operation space and is easy in maintenance is obtained.

In one embodiment of the present invention, the L-shaped engagement grooves engageable with the engagement pawls of the stopper fitting may be formed along the inner peripheral surface of the socket holder.

According to this embodiment, since the engagement grooves cannot be seen from outside, the connector has good appearance and can prevent penetration of dust and the like.

In another embodiment of the present invention, a screw type socket includes a socket holder, wherein the socket holder is a cylindrical body in which a socket body is arranged on the same shaft center, which prevents the socket body from slipping off, and whose inner peripheral surface facing the socket body is formed with the female screw portion, and wherein the insertion portion of the socket body is fitted into the fitting recess of the plug body, and the female screw portion of the screw type socket is screwed with the male screw portion of the plug holder, whereby the screw type socket may be connected and integrated with the plug.

In another embodiment of the present invention, a screw type plug includes a plug holder, wherein the plug holder is a cylindrical body, which is prevented from slipping off the outer peripheral surface of the plug body so as to be freely rotatable, and provided with the male screw portion at an end side of the outer peripheral surface thereof, and wherein the insertion portion of the socket body is fitted into the fitting recess provided in the plug body, and the male screw portion of the screw type plug is screwed with the female screw portion of the socket holder, whereby the screw type plug may be connected and integrated with the socket.

According to one embodiment of the present invention, the plug and the connector may be connected and integrated with a conventional screw type socket holder and a conventional screw type plug holder, respectively. Therefore, uselessly replacing the conventional screw type connector is avoided, and an easy-to-use connector is obtained.

In another embodiment of the present invention, the connection line may be an electrical cable. According to this embodiment, since the electrical cables can be connected by a single operation, a connector that has high connection operability does not require a wide operation space and easy maintenance is obtained.

DESCRIPTION OF NUMERALS

Figure 1:
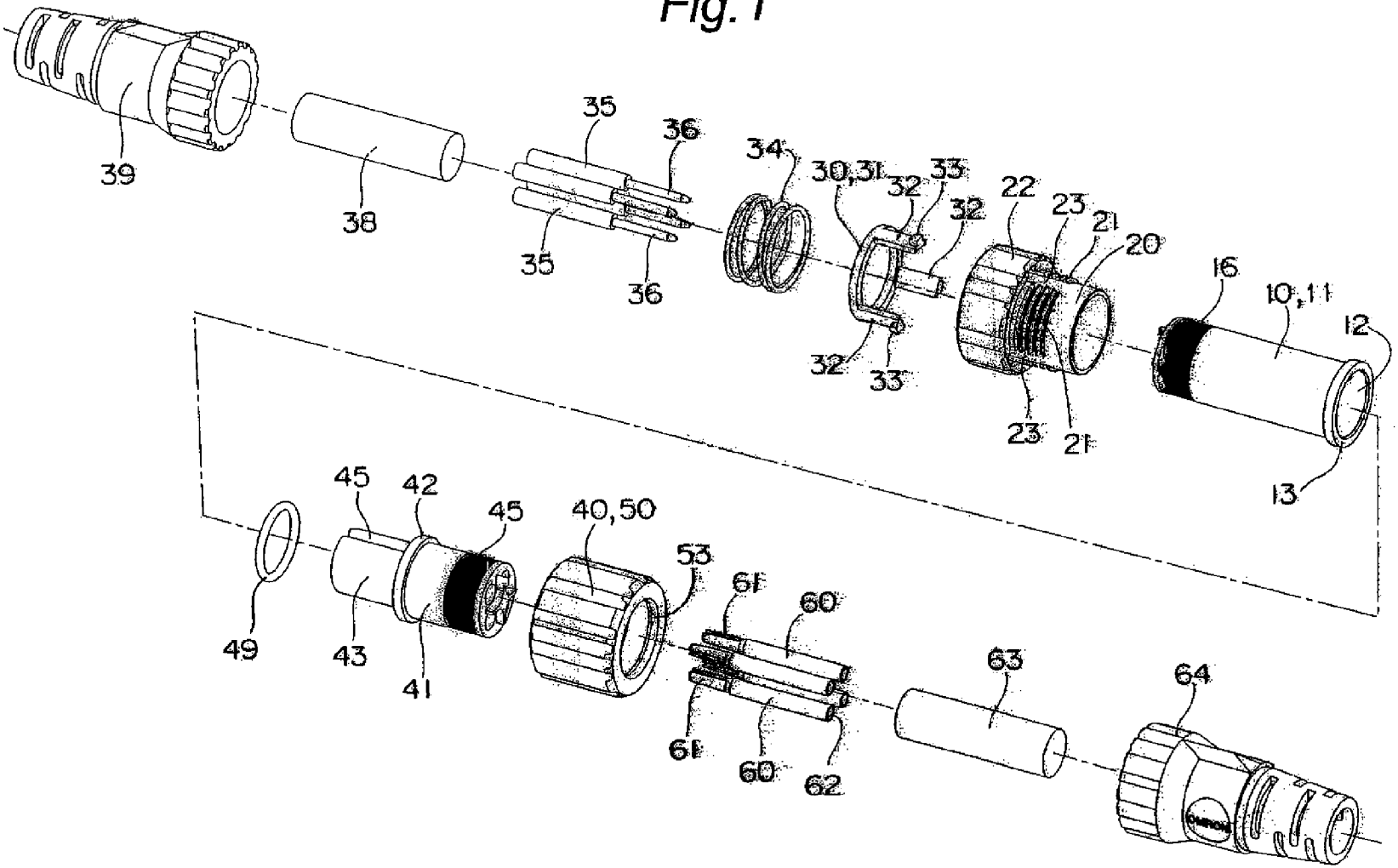
FIG. 1 is an exploded perspective view showing a first embodiment of a connector of the present invention.

10: bayonet type plug
11: plug body
12: fitting recess
13: annular rib
14: guide protrusion
15: terminal holes
17: pin terminals
18: pin portions
20: plug holder
21: male screw portion
22: annular rib for rotational operation
23: guide grooves
30: stopper fitting
32: engagement pawls
33: engagement projections
34: coil spring
35: pin terminals
36: pin portions
37: connection holes
38: electrical cable
39: plug shell portion
40: bayonet type socket
41: socket body
42: annular rib
43: insertion portion
44: terminal holes
45: guide groove
46: annular projections
49: O-ring
50: socket holder
51: female screw portion
52: engagement grooves
53: annular stopper rib
60: socket terminals
61: socket portions
62: connection holes
63: electrical cable
70: screw type socket
80: screw type plug

DETAILED DESCRIPTION

Embodiments of the connection structure of the present invention will be described with reference to the accompanying drawings of FIGS. 1 to 16. Like items in the figures are shown with the same reference numbers.

In embodiments of the invention, numerous specific details are set forth in order to provide a more thorough understanding of the invention. However, it will be apparent to one of the ordinary skill in the art that the invention may be practiced without these specific details. In other instances, well-known features have not been described in detail to avoid obscuring the invention.

As shown in FIGS. 1 to 6, a first embodiment is a connector for electrical connection, which includes a bayonet type plug 10 and a socket 40.

Figure 2:
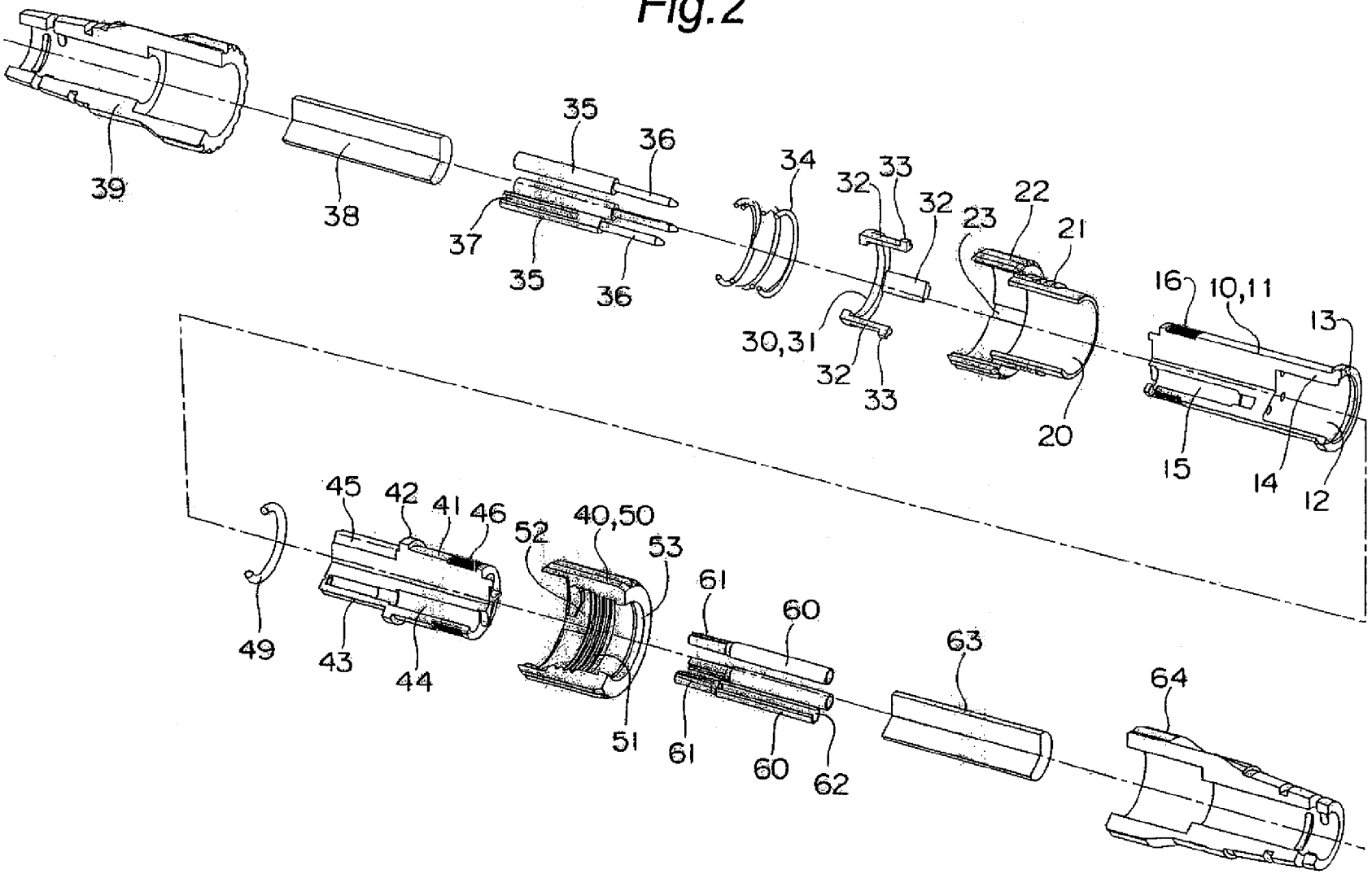
FIG. 2 is a cross-sectional exploded perspective view of the connector shown in FIG. 1.

As shown in FIGS. 1 and 2, the bayonet type plug 10 includes a plug body 11, a plug holder 20, a stopper fitting 30, a coil spring 34, four pin terminals 35, an electrical cable 38, and a plug shell portion 39.

The plug body 11 is a cylindrical resin molded article. An opening edge portion of a fitting recess 12, which is provided on one end surface side of the plug body 11, is provided with an annular rib 13 for preventing the plug holder 20 from slipping off. An inner peripheral surface of the fitting recess 12 is protrusively provided with a guide protrusion 14 (see FIG. 2) in a shaft center direction. On the other hand, four terminal holes 15 communicating with the fitting recess 12 are provided on the other end surface side of the plug body 11. Further, an edge portion on the other side of an outer peripheral surface of the plug body 11 is formed with a number of annular projections 16 in order to increase a contact area with the plug shell portion 39 and prevent it from slipping off.

The plug holder 20 has a cylindrical shape that can be freely rotatably fitted over the plug body 11. One end side half portion of an outer peripheral surface thereof is formed with a male screw portion 21, and an annular rib 22 for rotational operation is extended from an edge portion on the one end side of the outer peripheral surface. In the plug holder 20, guide grooves 23 are formed parallel to the shaft center and at equal pitches along an inner peripheral surface of the annular rib 22 for rotational operation and the outer peripheral surface of the plug body 11. Therefore, engagement pawls 32 of the stopper fitting 30 can be inserted through the guide grooves 23.

The stopper fitting 30 is formed from a ring portion 31, which has an outer circumferential shape that can be fitted into the inner peripheral surface of the annular rib 22 for rotational operation, and engagement pawls 32 protrusively provided parallel to the shaft center and at equal pitches. Tip end portions of the engagement pawls 32 are each provided with an engagement projection 33.

The coil spring 34 has an inner diameter that can be fitted over the plug body 11, and has a role of urging the stopper fitting 30 outward.

One side end portion of each pin terminal 35 is provided with each pin portion 36 which can be inserted into each socket portion 61 of each socket terminal 60 described below, and the other side end portion thereof is provided with each connection hole 37 to which a lead wire (not shown) of an electrical cable can be electrically connected.

The electrical cable 38 is obtained by coating a plurality of the lead wires (not shown) with a resin. The lead wires are respectively electrically connected to the connection holes 37 of the pin terminals 35 by soldering or press-fitting.

The plug shell portion 39 is integrally molded with resin in order to integrate the plug body 11 and the electrical cable 38.

Therefore, in the plug 10 made up of the above components, after respectively electrically connecting the lead wires of the electrical cable 38 to the connection holes 37 of the pin terminals 35, the pin terminals 35 are respectively press-fitted into the terminal holes 15 of the plug body 11, whereby the pin portions 36 are protruded from a bottom surface of the fitting recess 12 of the plug body 11. Then, the plug holder 20 is fitted over the plug body 11. Thereafter, the engagement pawls 32 of the stopper fitting 30 are inserted into the guide grooves 23 of the annular rib 22 so as to be fitted to the plug body 11, whereby it becomes possible for the plug holder 20 and the stopper fitting 30 to be integrally rotated. However, although the plug holder 20 and the stopper fitting 30 are urged outward by the coil spring 34, one end portion of the plug holder 20 comes in contact with the annular rib 13 of the plug body 11, so as to be prevented from slipping off. After that, the plug shell portion 39 is formed in a manner such that a connection portion of the plug body 11 and the electrical cable 38 is encapsulated with resin, whereby assembling of the plug 10 is completed.

As shown in FIGS. 1 and 2, the socket 40 is made up of a socket body 41, an O-ring 49, a socket holder 50, socket terminals 60, an electrical cable 63, and a socket shell body 64.

The socket body 41 is a cylindrical resin molded article provided with an annular rib 42 at the general center of its outer peripheral surface. One end side thereof serves as an insertion portion 43, and is provided with four terminal holes 44 communicating with both end surfaces thereof. An outer peripheral surface of the insertion portion 43 is provided with a guide groove 45 in the shaft center direction. Further, an edge portion on the other end side of the outer peripheral surface of the socket body 41 is formed with a number of annular projections 46 in order to increase a contact area with the socket shell portion 64 described below and prevent the socket body 41 from slipping off.

The socket holder 50 is a cylindrical body that can house the socket body 41. A central portion of an inner peripheral surface of the socket holder 50 is formed with a female screw portion 51, and an edge portion on the other end side thereof is formed with generally L-shaped engagement grooves 52 (see FIG. 6). On the other hand, an edge portion on one end side thereof is formed with an annular stopper rib 53.

The other side end portion of each socket terminal 60 is formed with the socket portion 61, into which the pin portion 36 of the pin terminal 35 can be inserted, and one side end portion thereof is provided with each connection hole 62, to which a lead wire (not shown) of the electrical cable 63 can be electrically connected by soldering or press-fitting.

Subsequently, the O-ring 49 is fitted over the socket body 41, and the lead wires of the electrical cable 63 are electrically connected to the socket portions 61 of the socket terminals 60, which are respectively press-fitted into the terminal holes 44 of the socket body 41. Then, after fitting the socket holder 50 over the socket body 41, the socket shell portion 64 is formed in a manner such that a connection portion of the socket body 41 and the electrical cable 63 is encapsulated with resin, whereby assembling of the socket 40 is completed.

Figure 3A:
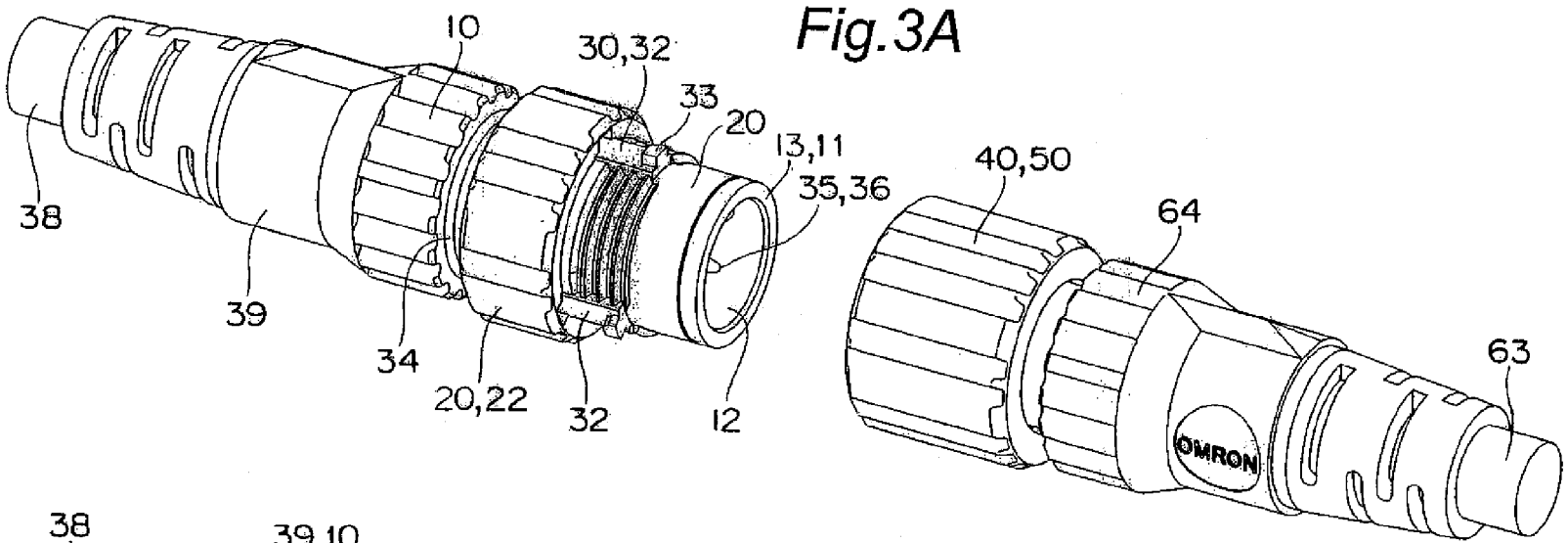
FIG. 3A and FIG. 3B are a perspective view and a cross-sectional perspective view, respectively, of the connector shown in FIG. 1 before connection of a socket and a plug.
Figure 3B:
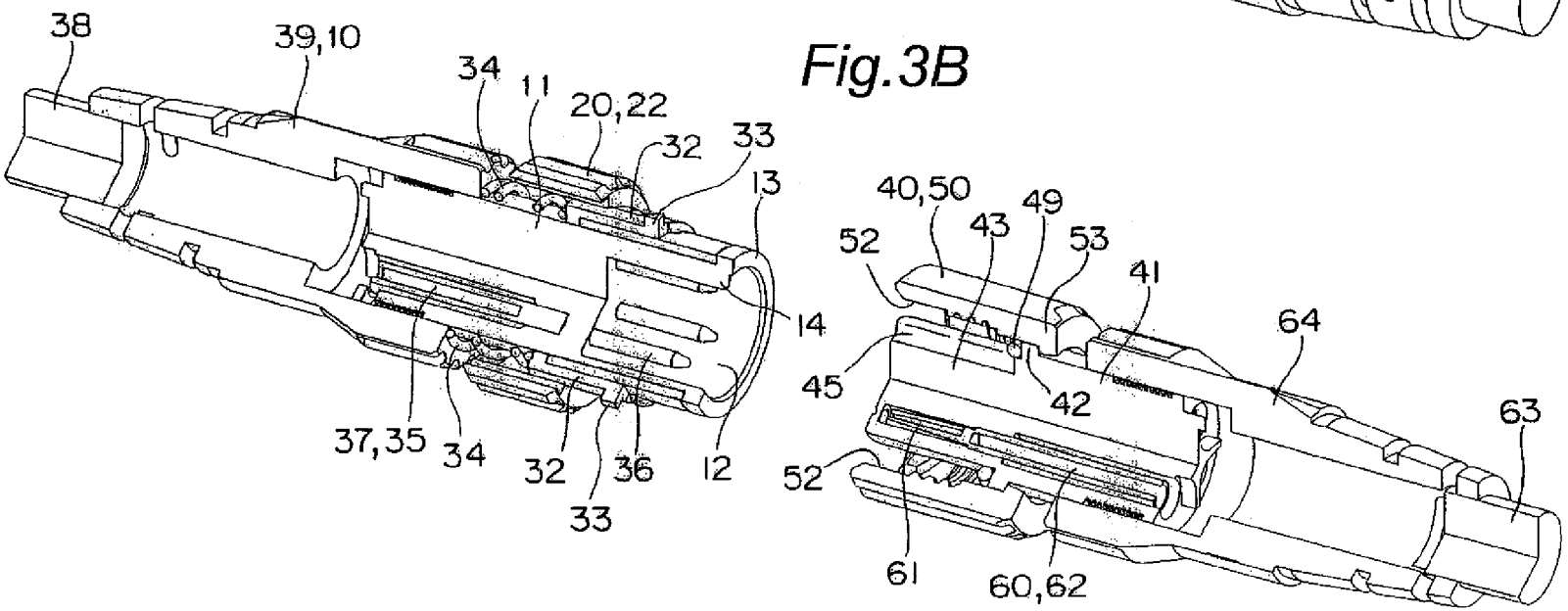
Figure 4A:
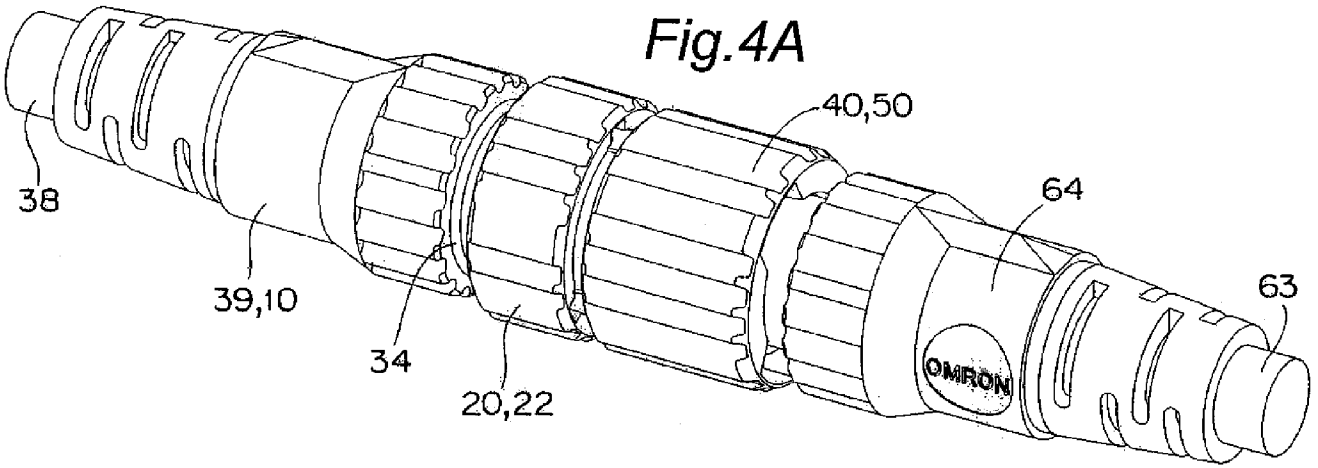
FIG. 4A and FIG. 4B are a perspective view and a cross-sectional perspective view, respectively, of the connector shown in FIG. 1 during the connection of the socket and the plug.
Figure 4B:
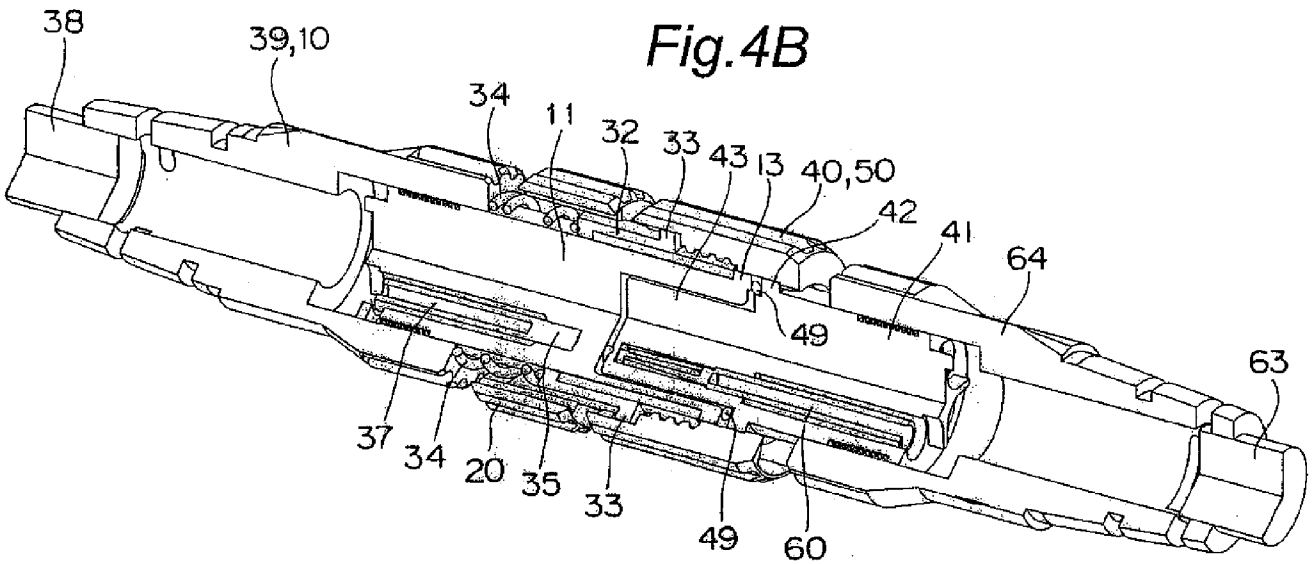
Figure 5A:
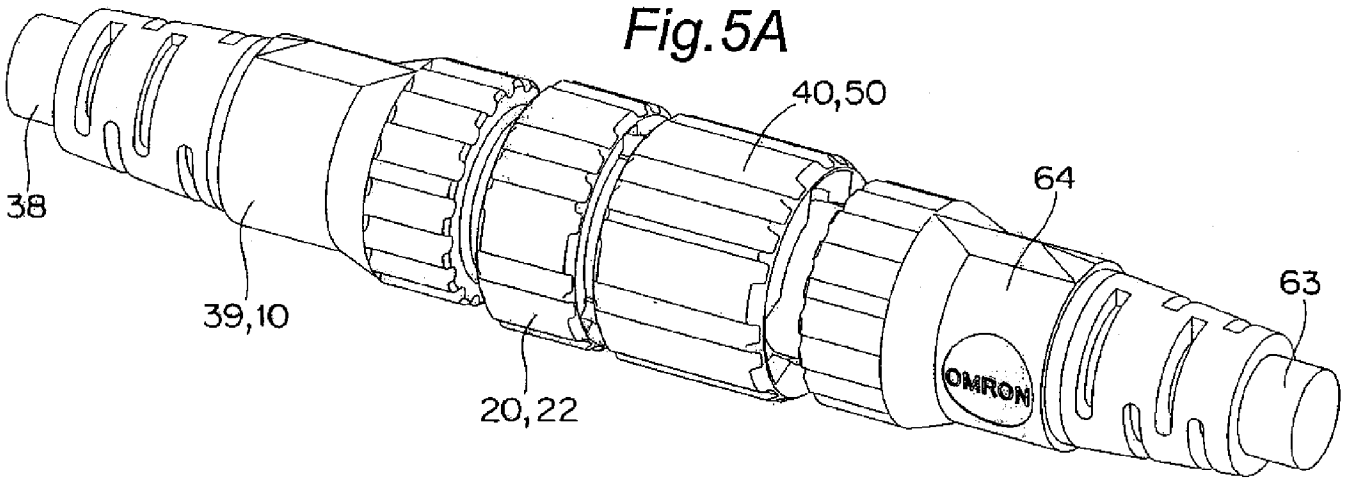
FIG. 5A and FIG. 5B are a perspective view and a cross-sectional perspective view, respectively, of the connector shown in FIG. 1 after the connection of the socket and the plug.
Figure 5B:
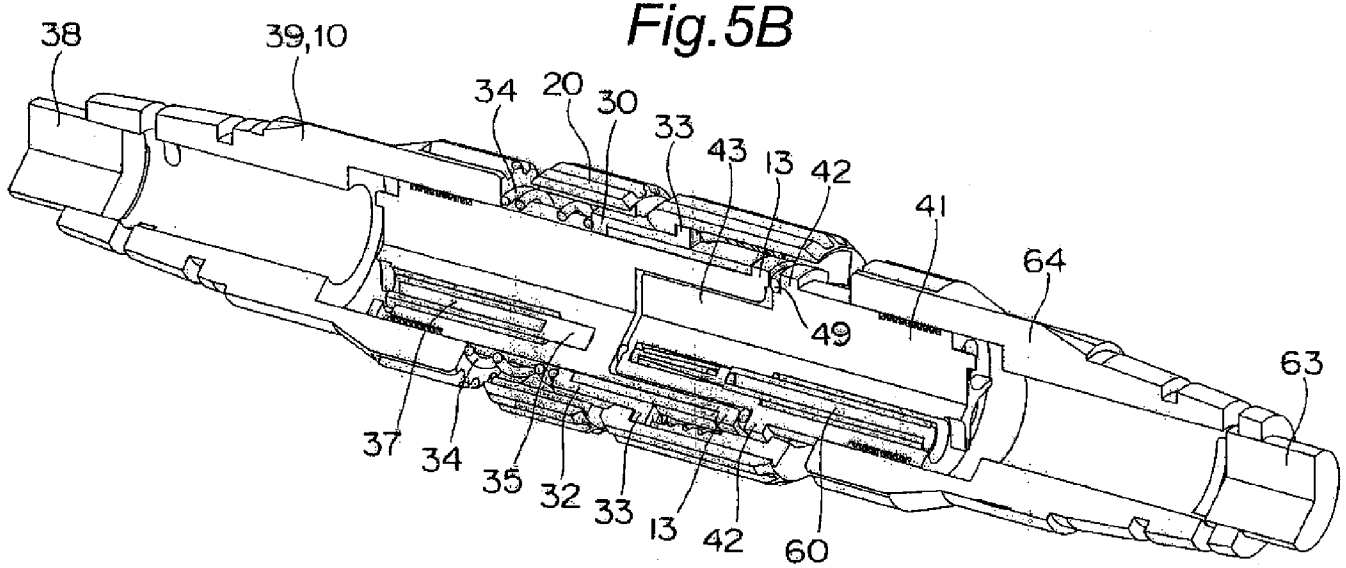
Figure 6:
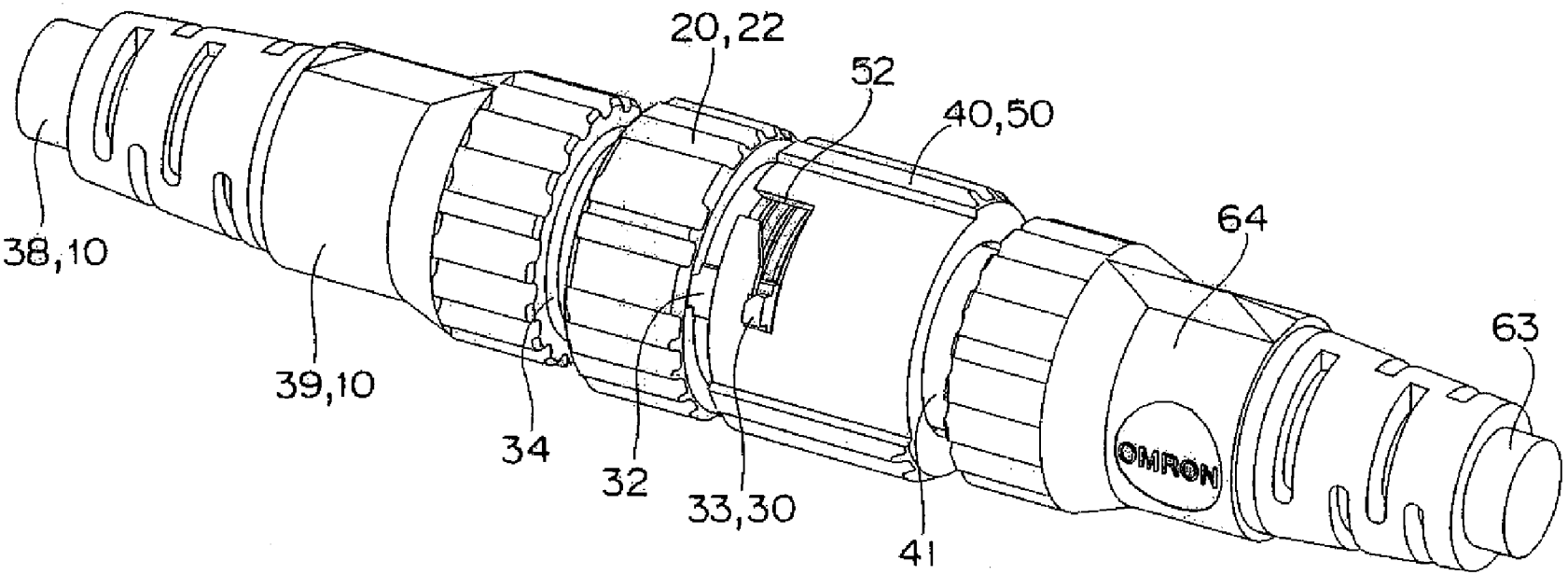
FIG. 6 is a partially broken perspective view in which a part of a socket shown in FIG. 5A is broken.

If the bayonet type plug 10 and socket 40 with the above structure are connected, as shown in FIG. 3, the guide groove 45 provided in the insertion portion 43 of the socket body 41 is fitted to the guide protrusion 14 provided on the fitting recess 12 of the plug body 11 to be positioned and the pin portions 36 of the pin terminals 35 are pushed and inserted into the socket portions 61 of the socket terminals 60 so as to be electrically connected. Further, the plug holder 20 and the socket holder 50 are rotated in opposite directions with respect to each other, whereby the engagement pawls 32 of the stopper fitting 30, which are urged outward due to a spring force of the coil spring 34, move forward into the generally L-shaped engagement grooves 52 provided in the inner peripheral surface of the socket holder 50, so that a sense of operation is obtained. After that, the plug holder 20 and/or the socket holder 50 is rotated, whereby the engagement projections 33 of the engagement pawls 32 are engaged with the engagement grooves 52 (see FIG. 6), so that the connector becomes locked. Therefore, the annular ribs 13, 42 compress and hold the O-ring 49, so that a high waterproof property can also be secured (FIG. 5B).

Figure 7A:
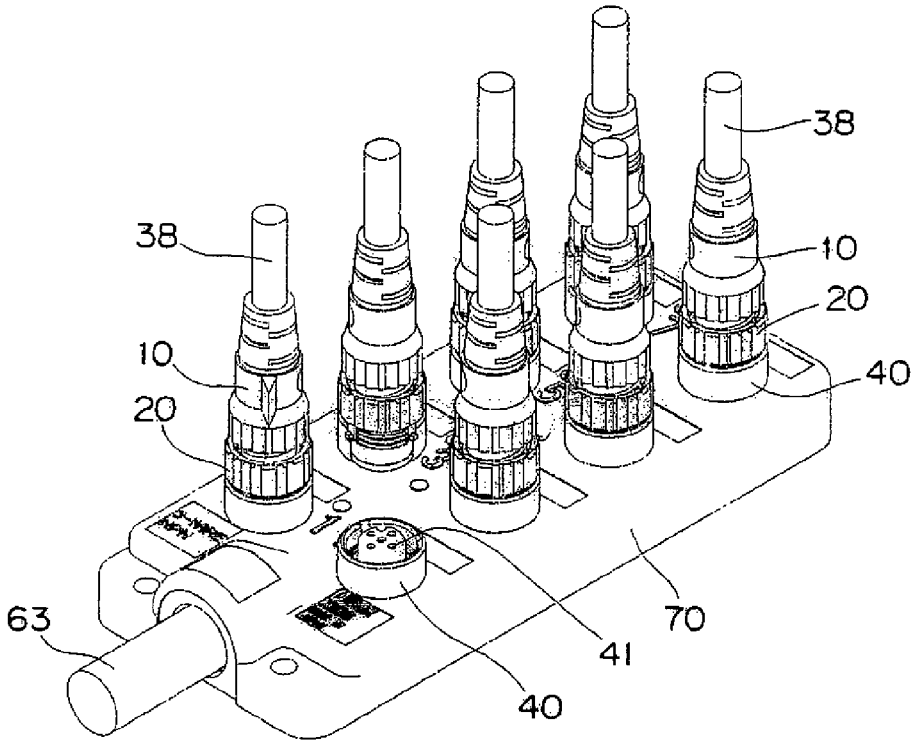
FIG. 7A and FIG. 7B are perspective views showing a second embodiment of the connector of the present invention.
Figure 7B:
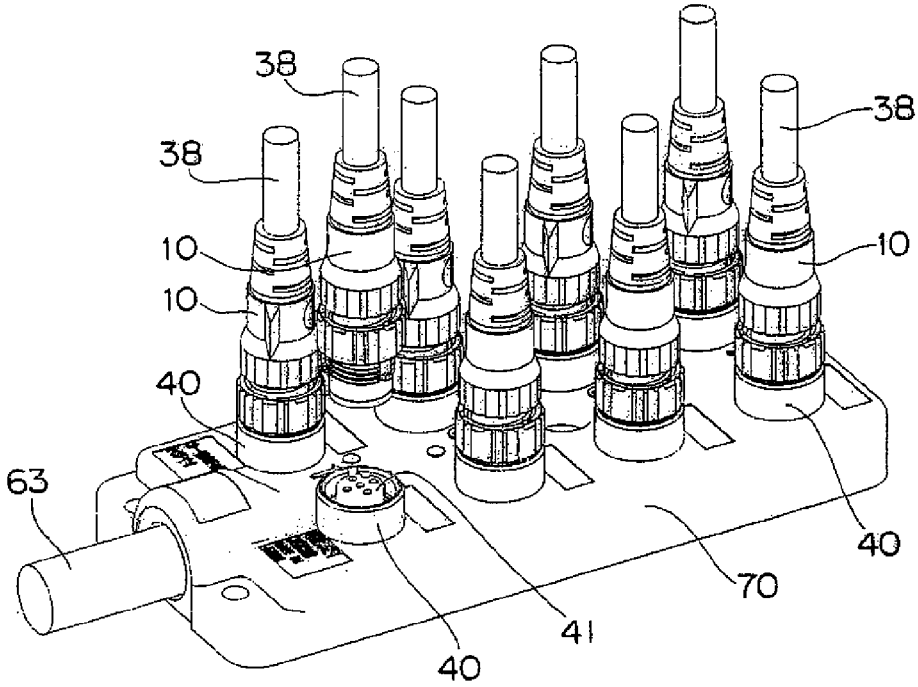

As shown in FIG. 7, in a second embodiment, the bayonet type plugs 10 are electrically connected to a socket stand 70 into which a number of the bayonet type sockets 40 are buried.

According to this embodiment, even when a number of the bayonet type plugs 10 are connected, the bayonet type plugs 10 are plugged into the bayonet type sockets 40 and each of the plug holders 20 is twisted by a predetermined angle so that they can be electrically connected to each other. Therefore, there is an advantage that a connector having good operability and a high integrated density is obtained.

Since the bayonet type plugs 10 and sockets 40 themselves are almost the same as those of the first embodiment, the same parts are designated by the same numerals, and their description is omitted.

As shown in FIGS. 8 to 11, a third embodiment is a case in which the bayonet type plug 10 is connected to an existing screw type socket 70. Since the bayonet type plug 10 is almost the same as that of the first embodiment, the same parts are designated by the same numerals, and their description is omitted.

Figure 14A:
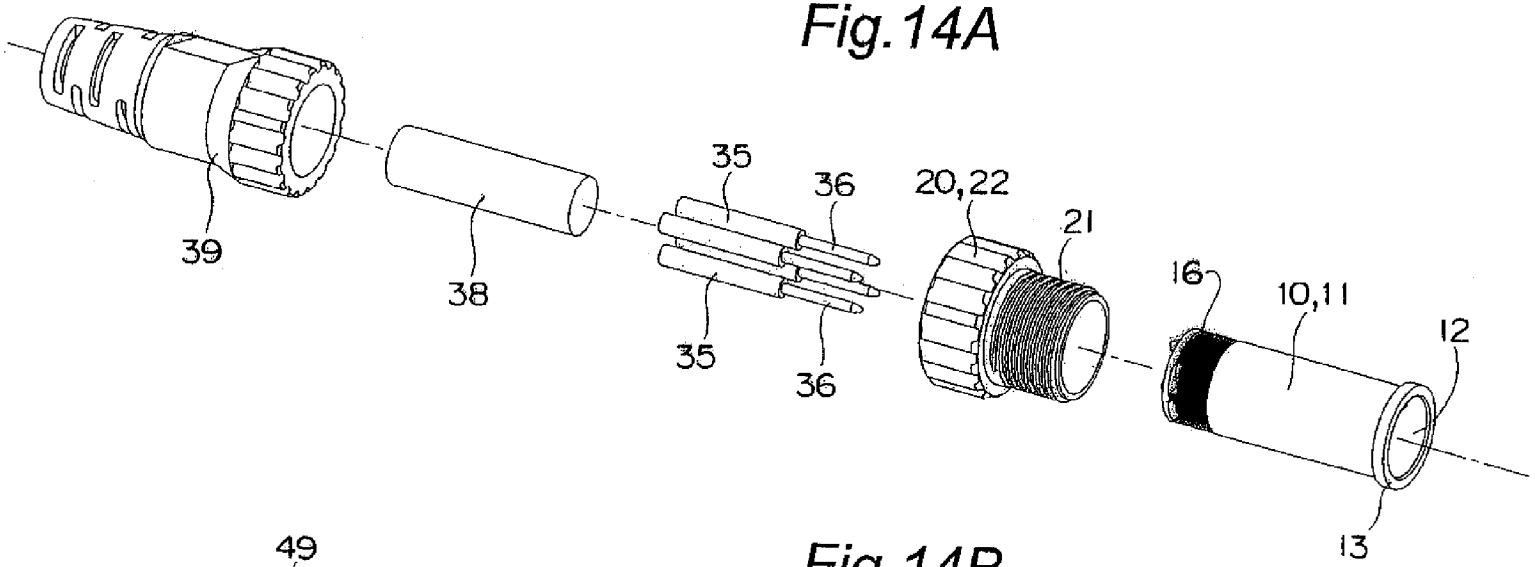
FIG. 14A and FIG. 14B are exploded perspective views showing an existing plug and socket, respectively.
Figure 14B:
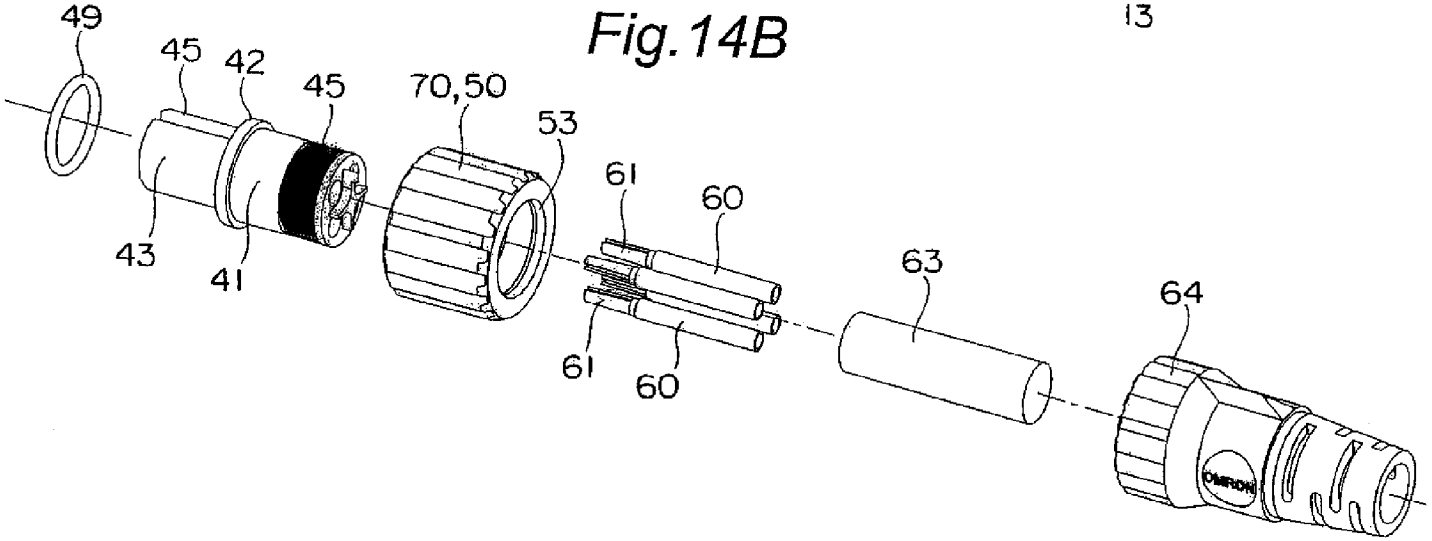
Figure 15A:
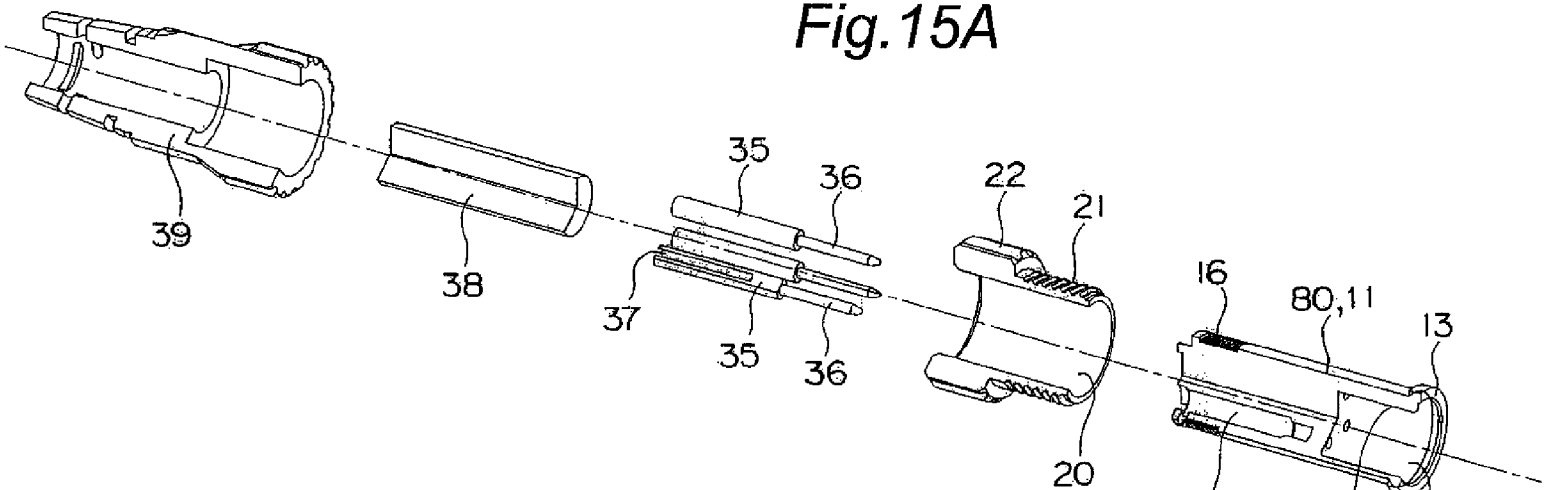
FIG. 15A and FIG. 15B are cross-sectional exploded perspective views showing the existing plug and socket shown in FIG. 14A and FIG. 14B, respectively.
Figure 15B:
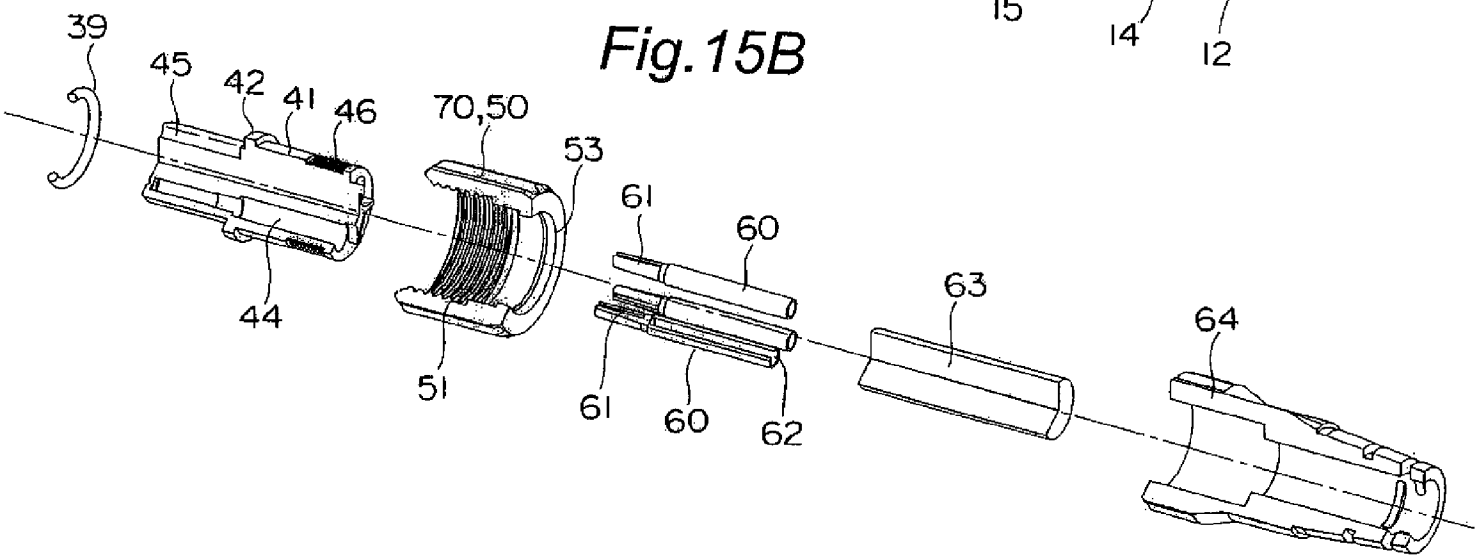
Figure 16A:
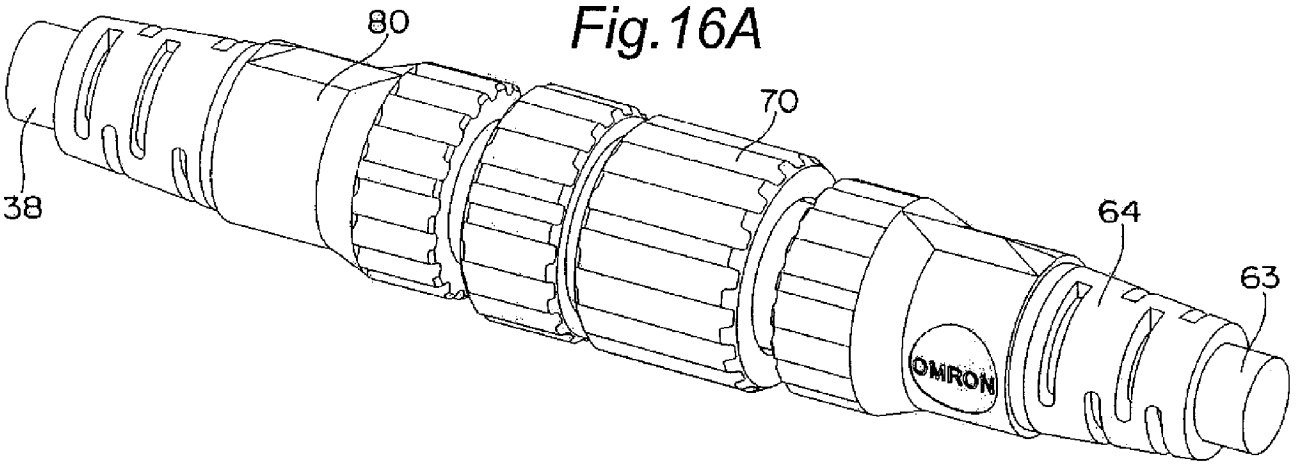
FIG. 16A and FIG. 16B are a perspective view and a cross-sectional perspective view, respectively, of the connector shown in FIG. 14 after connection of a socket and a plug.
Figure 16B:
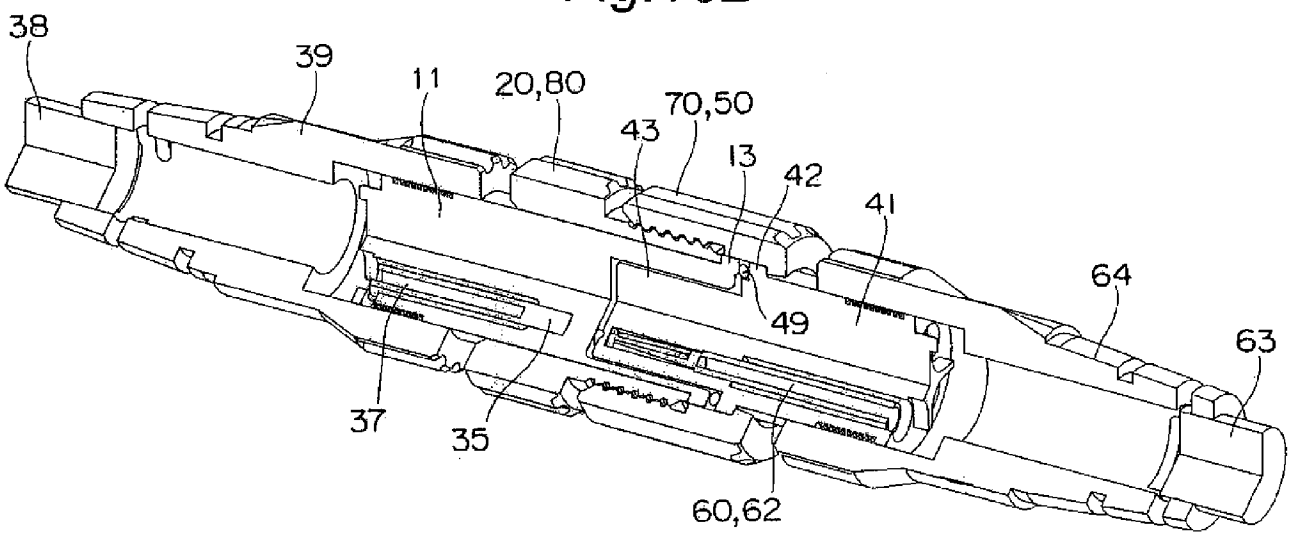

As shown in FIGS. 14A, 15B and 16, the screw type socket 70 is almost the same as the socket 40 shown in the first embodiment, but one side half portion of the inner peripheral surface of the socket holder 50 is formed with only a female screw portion 51. Since the rest are the same as those of the bayonet type socket 40, the same portions are designated by the same numerals, and their description is omitted.

Figure 8A:
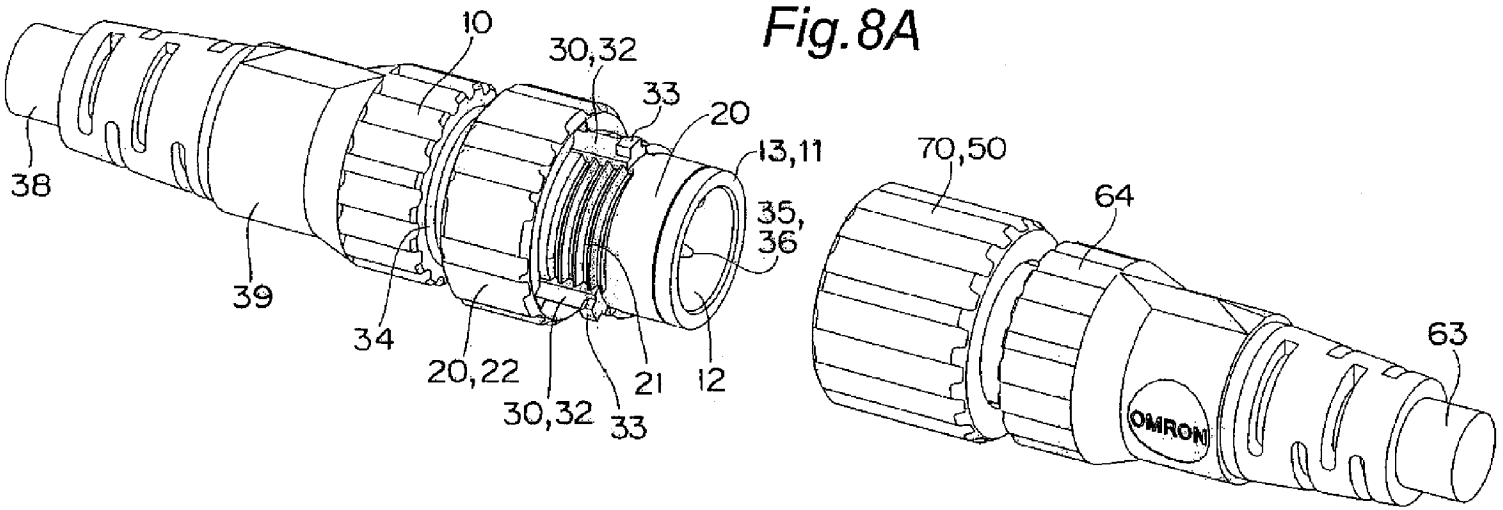
FIG. 8A and FIG. 8B are a perspective view and a cross-sectional perspective view, respectively, of a third embodiment of the connector of the present invention before connection of a socket and a plug.
Figure 8B:
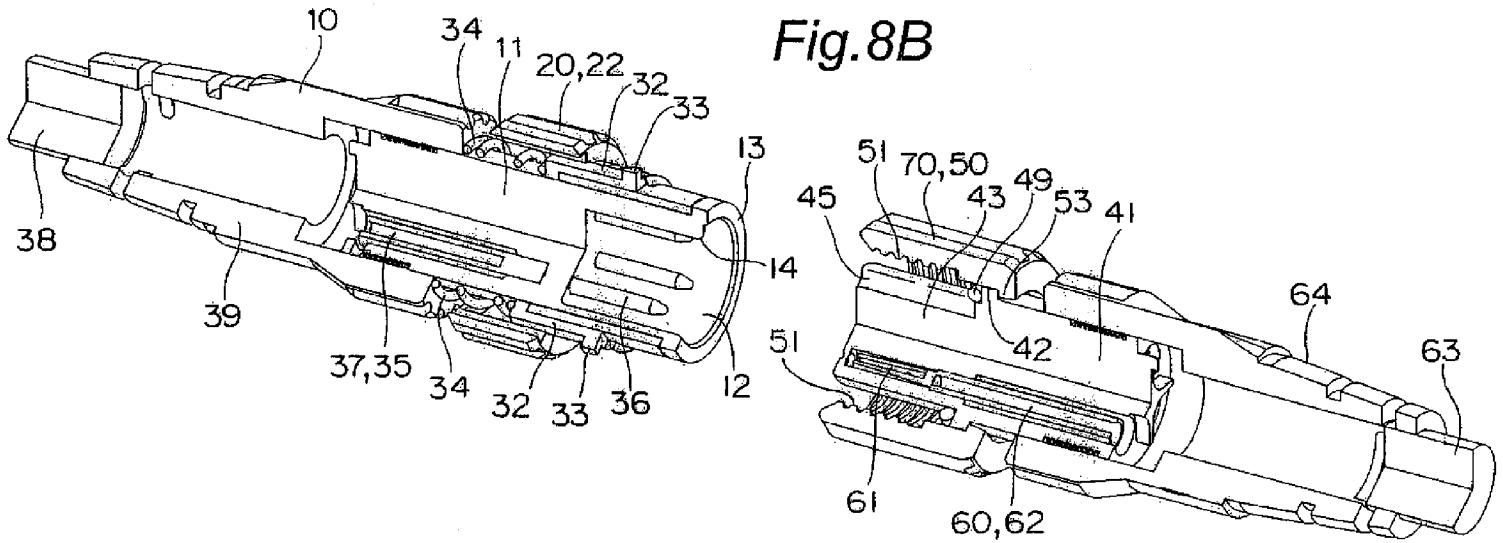
Figure 9A:
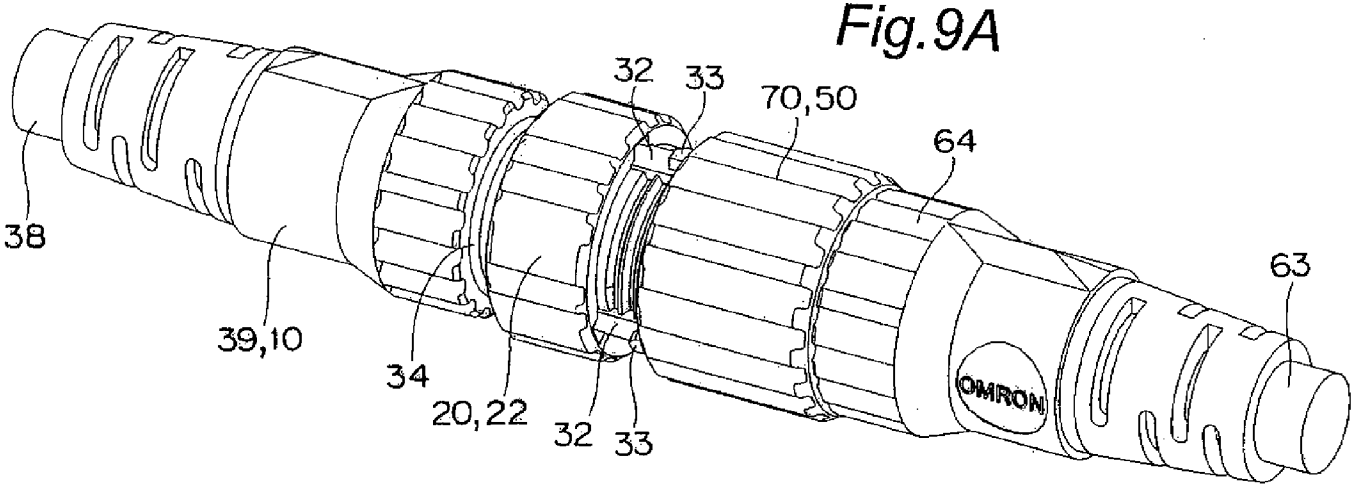
FIG. 9A and FIG. 9B are a perspective view and a cross-sectional perspective view, respectively, of the connector shown in FIG. 8 during the connection of the socket and the plug.
Figure 9B:
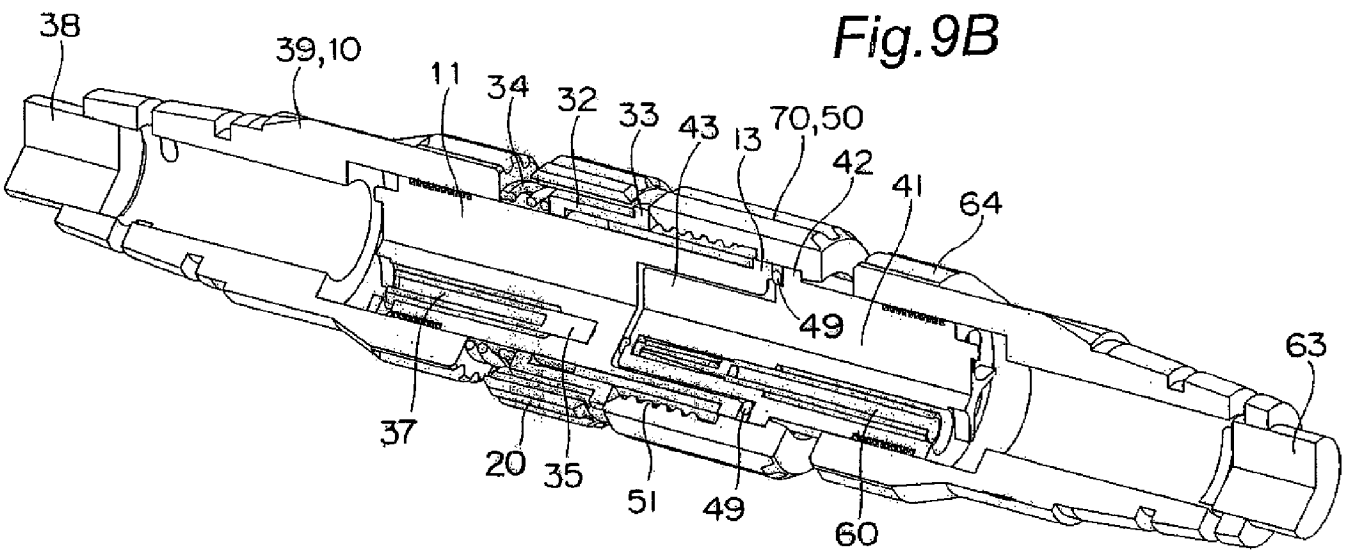
Figure 10A:
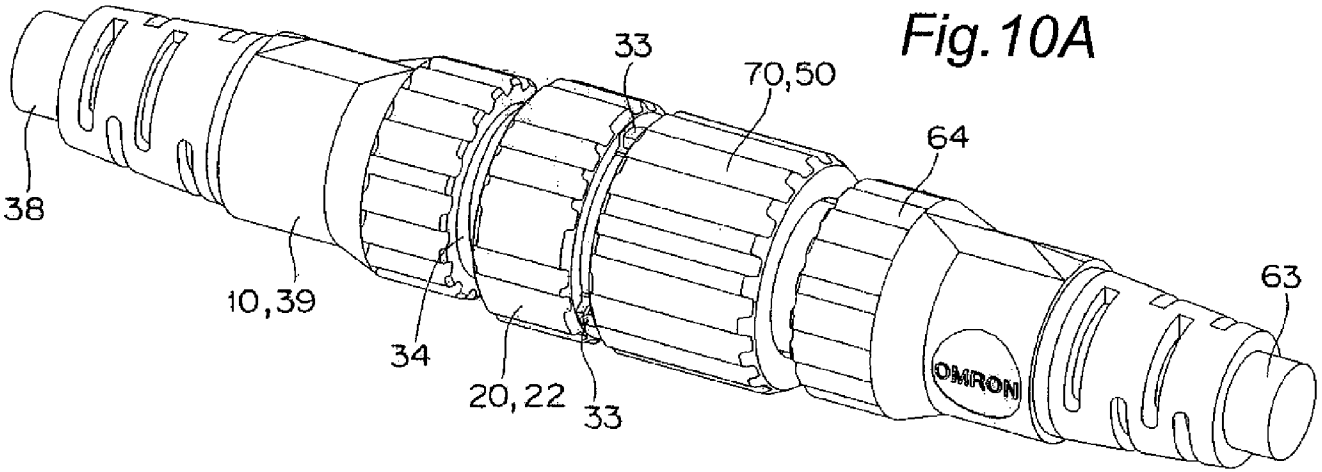
FIG. 10A and FIG. 10B are a perspective view and a cross-sectional perspective view, respectively, of the connector shown in FIG. 8 after the connection of the socket and the plug.
Figure 10B:
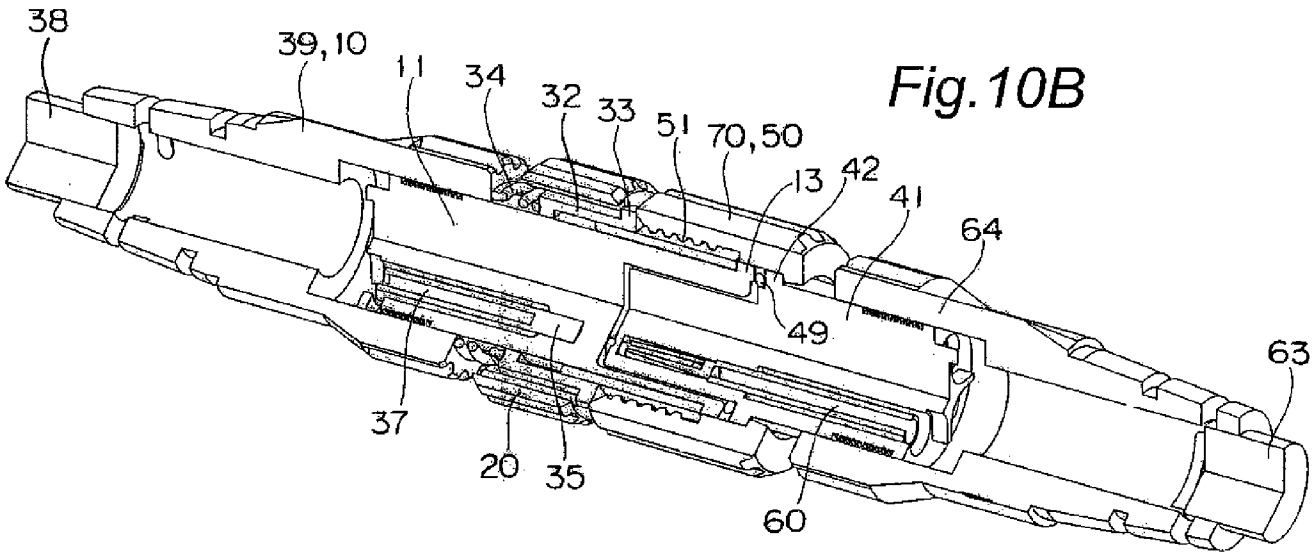
Figure 11:
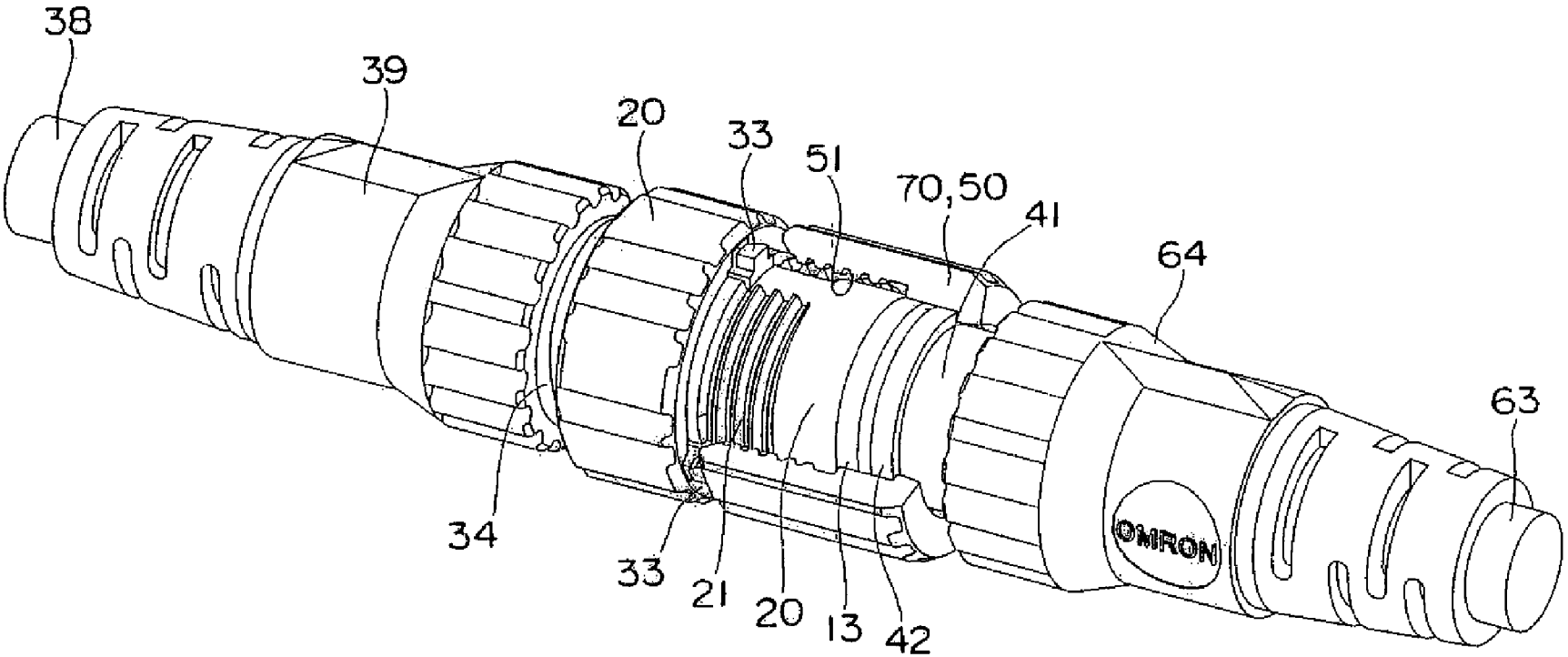
FIG. 11 is a partially broken perspective view in which a part of a socket shown in FIG. 10A is broken.

If the bayonet type plug 10 and the screw type socket 70 with the above constitution are connected, as shown in FIG. 8, the guide groove 45 provided in the insertion portion 43 of the socket body 41 is fitted to the guide protrusion 14 provided on the fitting recess 12 of the plug body 11 to be positioned, and the pin portions 36 of the pin terminals 35 are pushed and inserted into the socket portions 61 of the socket terminals 60 so as to be electrically connected. Further, the plug holder 20 and the socket holder 50 are rotated in opposite directions with respect to each other, whereby the female screw portion 51 of the socket holder 50 is screwed with the male screw portion 21 of the plug holder 20. Therefore, a tip end surface of the socket holder 50 is brought into press contact with the engagement projections 33 of the stopper fitting 30, and pushes the stopper fitting 30 against a spring force of the coil spring, so that the connector becomes locked. As a result, the annular ribs 13, 42 compress and hold the O-ring 49, so that a high waterproof property can be secured.

According to this embodiment, the plug can also electrically be connected to the existing screw type socket 70, and there is an advantage that the applicable scope is widened and it becomes more convenient.

Figure 12A:
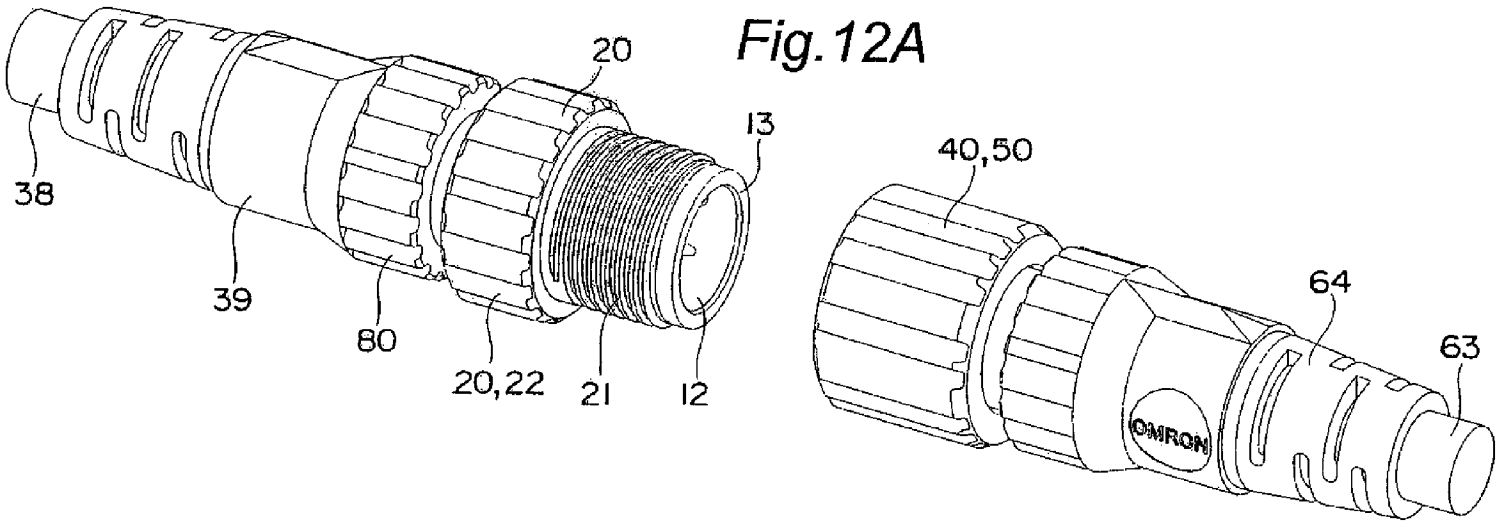
FIG. 12A and FIG. 12B are a perspective view and a cross-sectional perspective view, respectively, of a fourth embodiment of the connector of the present invention before connection of a socket and a plug.
Figure 12B:
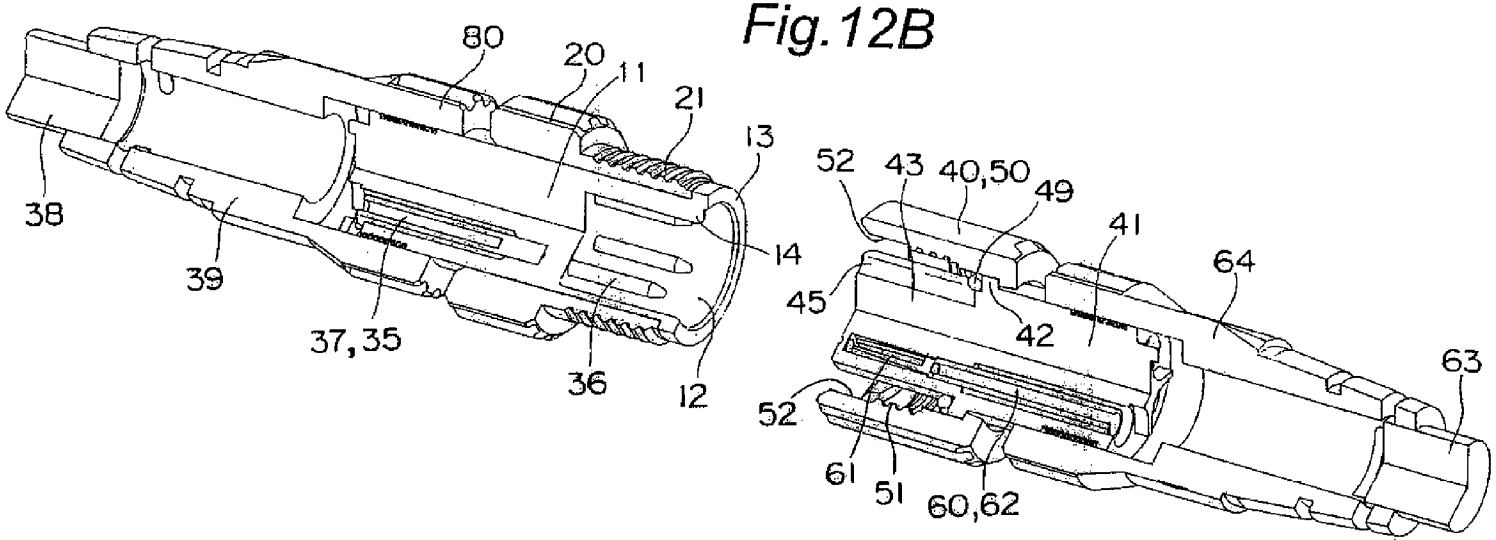
Figure 13A:
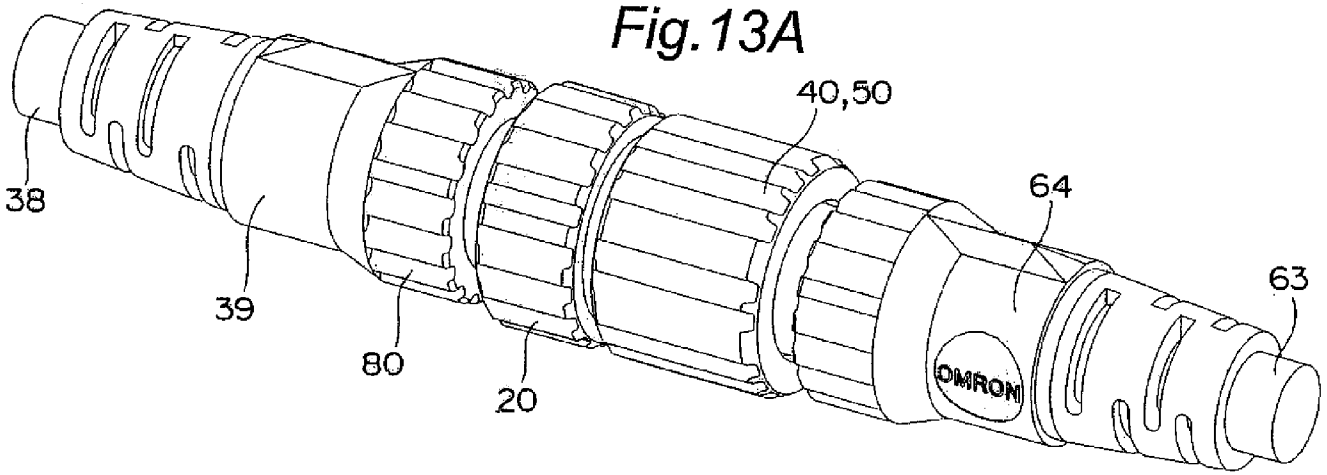
FIG. 13A and FIG. 13B are a perspective view and a cross-sectional perspective view, respectively, of the connector shown in FIG. 12B after the connection of the socket and the plug.
Figure 13B:
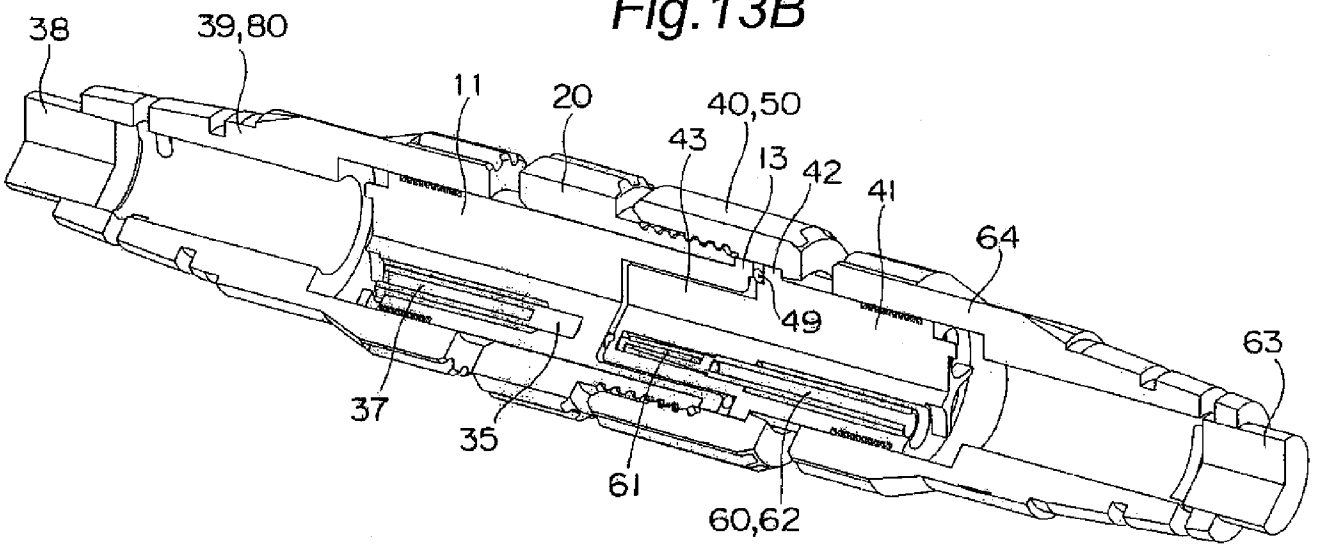

As shown in FIGS. 12 and 13, in a fourth embodiment, the bayonet type socket 40 disclosed in the first embodiment is connected to an existing screw type plug 80. The existing screw type plug 80 is almost the same as the plug 10 of the first embodiment except that it has no stopper fitting or coil spring and that the shape of the plug holder 20 is slightly different as shown in FIGS. 14A, 15A and 16. In particular, as shown in FIG. 15A, the plug holder 20 has a cylindrical shape that can be freely rotatably fitted over the plug body 11, one end side of an outer peripheral surface of the plug holder 20 is protrusively provided with the rib 22 for rotational operation, and the remaining outer peripheral surface thereof is formed with the male screw portion 21. The same parts are designated by the same numerals, and their description is omitted.

If the screw type plug 80 and the bayonet type socket 40 are connected, as shown in FIGS. 12 and 13, the guide groove 45 provided in the insertion portion 43 of the socket body 41 is fitted to the guide protrusion 14 provided on the fitting recess 12 of the plug body 11 to be positioned and the pin portions 36 of the pin terminals 35 are pushed and inserted into the socket portions 61 of the socket terminals 60 so as to be electrically connected. Further, the plug holder 20 and the socket holder 50 are relatively rotated in opposite directions with respect to each other, whereby the female screw portion 51 of the socket holder 50 is screwed with the male screw portion 21 of the plug holder 20 to fasten the male screw portion 21, whereby the connector becomes locked. Therefore, the annular ribs 13, 42 compress and hold the O-ring 49, so that a high waterproof property can be secured.

In the above embodiments, although a case where a pair of electrical cables are directly connected on the same shaft center was described, the electrical cables may also be connected to a socket fixed to an attachment plate in advance through a plug. Further, if a socket holder is fitted over a socket body, it is preferred that a slight play be provided with respect to the socket body in the shaft center direction.

INDUSTRIAL APPLICABILITY

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims. For example, the connector may be applied not only to electrical connection but also to a case where pipes through which a gas or a liquid flows are connected on the same shaft center.

The invention claimed is:

1. A connector comprising:

a plug and a socket that are connected and integrated to each other at one end, the plug and the socket each having another end to which a connection line can be respectively connected, whereby the connection lines connected respectively to the plug and the socket are connected to each other, wherein the plug comprises:

a plug body for connecting to the connection line on one end thereof and having a fitting recess on the other end thereof;

a plug holder shaped in a substantially cylindrical form and configured to be freely rotatably fitted over the plug body without slipping off an outer peripheral surface of the plug body, wherein the plug holder comprises:

a male screw portion formed on one end side of the outer peripheral surface of the plug holder;

an annular rib for rotational operation extended from an edge portion on the one end side of the outer peripheral surface; and at least one guide groove formed in the outer peripheral surface in a shaft center direction; and a stopper fitting biased outward along the shaft center direction and configured to be freely rotatably fitted over the plug body and separately slidable in the shaft center direction, wherein the stopper fitting comprises:

a ring portion; and at least one engagement pawl protruding from the ring portion toward the guide groove of the plug holder in a direction parallel to the shaft center direction, and configured to be engageable with the plug holder so that the stopper fitting is integrally rotatable with the plug holder, wherein an engagement projection is provided at a tip end of each of the at least one engagement pawl, and the socket comprises:

a socket body for connecting to the connection line at one end thereof and having an insertion portion protrusively provided on the other end thereof, wherein the insertion portion is configured to fit into the fitting recess of the plug body; and a socket holder shaped in a substantially cylindrical form, and configured to be freely rotatably fitted over the socket body without slipping off the socket body and such that the socket holder rotates in an opposite direction with respect to the plug holder, wherein the socket holder comprises:

L-shaped engagement grooves formed on an opening edge side of the socket holder, and configured to be engageable with the engagement projections provided at the tip end of the at least one engagement pawl of the stopper fitting; and a female screw portion formed on an inner peripheral surface of the socket holder and configured to be engageable with the male screw portion of the plug holder.

2. The connector according to claim 1, wherein the L-shaped engagement grooves engageable with the at least one engagement pawl of the stopper fitting are formed along the inner peripheral surface of the socket holder.

3. The connector according to claim 2, wherein the connection line is an electrical cable.

4. The connector according to claim 1, wherein the connection line is an electrical cable.

5. A plug comprising:

a plug body for connecting to a connection line on one end thereof and having a fitting recess on the other end thereof;

a plug holder shaped in a substantially cylindrical form and configured to be freely rotatably fitted over the plug body without slipping off an outer peripheral surface of the plug body, wherein the plug holder comprises:

a male screw portion formed on one end side of the outer peripheral surface of the plug holder;

an annular rib for rotational operation extended from an edge portion on the one end side of the outer peripheral surface; and at least one guide groove formed in the outer peripheral surface in a shaft center direction; and a stopper fitting biased outward along the shaft center direction and configured to be freely rotatably fitted over the plug body and separately slidable in the shaft center direction, wherein the stopper fitting comprises:

a ring portion; and at least one engagement pawl protruding from the ring portion toward the guide groove of the plug holder in a direction parallel to the shaft center direction, and configured to be engageable with the plug holder so that the stopper fitting is integrally rotatable with the plug holder, wherein an engagement projection is provided at a tip end of each of the at least one engagement pawl.

6. The plug according to claim 5, wherein the connection line is an electrical cable.

7. The plug according to claim 5, wherein the L-shaped engagement grooves engageable with the at least one engagement pawl of the stopper fitting are formed along the inner peripheral surface of a socket holder.

8. The plug according to claim 7, wherein the connection line is an electrical cable.

9. A socket comprising:

a socket body for connecting to a connection line at one end thereof and having an insertion portion protrusively provided on the other end thereof; and a socket holder shaped in a substantially cylindrical form and configured to be freely rotatably fitted over the socket body without slipping off the socket body, wherein the socket holder comprises:

L-shaped engagement grooves formed on an opening edge side of the socket holder, and configured to be engageable with the engagement projections provided at the tip end of the at least one engagement pawl of the stopper fitting; and a female screw portion formed on an inner peripheral surface of the socket holder and configured to be engageable with a male screw portion of a plug holder.

10. The socket according to claim 9, wherein the L-shaped engagement grooves engageable with the at least one engagement pawl of the stopper fitting are formed along the inner peripheral surface of the socket holder.

11. The connector according to claim 10, wherein the connection line is an electrical cable.

12. The socket according to claim 9, wherein the connection line is an electrical cable.

* * * * *